United States Patent [19]

Thomas

[11] 4,336,885

[45] * Jun. 29, 1982

[54] SECURITY DISPLAY RACK

[75] Inventor: Robert E. Thomas, Santa Ana, Calif.

[73] Assignee: Securax, Inc., Ft. Worth, Tex.

[ * ] Notice: The portion of the term of this patent subsequent to May 27, 1997, has been disclaimed.

[21] Appl. No.: 98,340

[22] Filed: Nov. 29, 1979

Related U.S. Application Data

[63] Continuation-in-part of Ser. No. 907,770, May 19, 1978, Pat. No. 4,204,601.

[51] Int. Cl.[3] ..... F05B 73/00

[52] U.S. Cl. ..... 211/4; 70/59; 70/62; 211/7

[58] Field of Search ..... 211/4, 7, 8, 124; 70/58, 59, 62

[56] References Cited

U.S. PATENT DOCUMENTS 839,298 12/1906 Kitterman ..... 211/4 X 3,690,130 9/1972 Eutzler ..... 211/4 X 4,204,601 5/1980 Thomas ..... 211/4

*Primary Examiner*—Roy D. Frazier

*Assistant Examiner*—Robert W. Gibson, Jr.

*Attorney, Agent, or Firm*—Gordon L. Peterson

[57] ABSTRACT

A security display rack for articles comprising an elongated outer channel having first and second legs, a web interconnecting the legs, and a plurality of notches extending through the legs and opening at the outer edges of the legs. An inner channel having first and second legs and a web interconnecting the legs of the inner channel are received in the outer channel with the legs of the inner channel extending from the web of the inner channel toward the web of the outer channel. A plurality of pins is carried by the web of the inner channel and is adapted to engage one of the articles with such article projecting through the grooves in the outer channel. A locking member is mounted on the channel for opening and closing the ends of the grooves.

9 Claims, 8 Drawing Figures

SECURITY DISPLAY RACK

CROSS REFERENCE TO RELATED APPLICATION

This application is a continuation-in-part of application Ser. No. 907,770 filed May 19, 1978, and entitled Security Display Rack, now U.S. Pat. No. 4,204,601.

BACKGROUND OF THE INVENTION

A growing problem in department stores is the mass theft of merchandise from display racks. Expensive garments, such as suits, are typically hung on hangers which in turn are suspended from a conventional garment display rack in the usual manner. Because the hangers are very easily removed from the rack, a large number of the hangers can be simultaneously removed from the rack quite easily, and this enables the thief to commit the theft during the time that the store is open for business. The display of jewelry, such as necklaces, bracelets, chains, etc. presents a special problem.

One approach is to put the merchandise within locked cabinets, such as is done, for example, with more expensive jewelry. This approach is not satisfactory because it reduces customer accessibility to the merchandise. Another approach employs a rack on which clothes hangers can be hung. The hangers are locked on the rack by a bar which is suitably locked over the top of the hangers. This rack is generally considered too unsightly for a merchandise display rack, and it does not properly space the articles hung on the rack. This is particularly true on a certain standard form of rack which extends at a 30-degree angle relative to the horizontal. Also, this prior art construction is not adapted for retrofit on existing non-locking display racks.

SUMMARY OF THE INVENTION

This invention generally overcomes the disadvantages noted above in providing a security display rack which is particularly adapted for the display of hand bags and jewelry items which can be formed into a loop, such as necklaces, chains, bracelets, etc. The feature which makes the security display rack adapted for these uses is incorporated into the display rack in such a way as to not adversely affect the appearance of the rack. This is considered particularly important in the merchandising field.

The security display rack can advantageously include an elongated support member having an elongated surface and a plurality of grooves extending through the support member and opening at the elongated surface. Each of the grooves is adapted to have at least a portion of an article inserted therein with the grooves serving to space the articles along the support member. The "article" which is received in the groove may be the item which is to be sold or it may be, or include, a hanger for the article to be sold. For example, articles, such as necklaces, ladies' purses, golf clubs, guns, etc., may be received directly into the groove, whereas clothing, such as men's suits, are customarily hung on a hanger and the hanger would be hung on the support member in one of the grooves.

An elongated locking member which is adapted to cover the open ends of the grooves is provided for retaining the articles in the grooves. The locking member is mounted for movement to open and at least partially close the open ends of the grooves. The locking member has a closed position in which it lies along the elongated surface of the support member to at least partially close the open ends of all of the grooves sufficiently to prevent or substantially impede withdrawal of the article from the groove. Locking means is provided for locking the locking member in the closed position.

To permit articles to be suspended from the support member, the support member is preferably elevated above a supporting surface, and means coupled to the supporting surface is provided for this purpose. A commonly used form of display rack of the non-security type typically includes a base and an upwardly extending riser into which a post from the standard display rack is telescopically received. To adapt the present invention for retrofit on this commonly used standard form of rack, it is preferred to provide a post coupled to the support member and attachable to the riser. In this manner, the base and riser from the existing units can be salvaged.

The support member can be simply and inexpensively constructed by making it in the form of a channel having first and second legs interconnected by a web. With this construction, each of the grooves includes a notch or groove section in each of the first and second legs. The channel also serves as a means for concealing various other portions of the display rack, such as the locking means.

The locking member can be mounted for movement to open and close the open ends of the grooves in different ways. For example, the locking member can be pivotally mounted on the support member for movement between the closed position and a position in which one or more of the grooves is open to permit removal of the article. Alternatively, the locking member can be appropriately mounted for sliding movement along the elongated surface of the support member. In a preferred construction, the mounting means includes one or more flanges on one of the support member and the locking member and a corresponding number of recesses on the other of the support member and the locking member. The flanges are received in the recess to permit the locking member to be slid over the open ends of the grooves to open and close the open ends of the grooves. When the support member is in the form of a channel, flanges can be inexpensively and advantageously provided by appropriately configuring the end portions of the legs of the channel remote from the web. For a neater appearance, the flanges extend outwardly of the associated leg. Corresponding recesses are appropriately formed on the locking member to slidably mount the locking member on the support member.

The security display rack of this invention includes a plurality of projections within the elongated outer channel. Thus, the security display rack is adapted for the display of articles which include or utilize an element which can be placed over, or otherwise engage, one of the projections. For example, a loop or a link forming a portion of a necklace or bracelet can be placed over one of the projections, with the necklace or bracelet projecting from the projection out of the outer channel through the notches in the outer channel. Other articles can be similarly caused to cooperate with one of the projections for display by the security display rack.

To facilitate construction and assembly of the rack, the rack preferably includes an inner channel having first and second legs and a web interconnecting the legs of the inner channel. The projections are carried by the web of the inner channel. The inner channel is received in the outer channel with the legs of the inner channel extending from the web of the inner channel toward the web of the outer channel. The projections extend away from the webs of the channels. With this construction, the inner channel can be completely concealed within the outer channel and the outer channel bears no marks of having the projections attached thereto. Furthermore, assembly is facilitated in that the projections can be mounted on the inner channel and, thereafter, the inner channel can be easily placed within the outer channel and affixed to the outer channel.

In order that the inner channel can be concealed within the outer channel, the legs of the inner channel should project from the web of the inner channel a distance less than the distance which the legs of the outer channel extend from the web of the outer channel. Also, the inner channel preferably lies between the bottoms of the notches in the outer channel and the web of the outer channel so that it is not readily visible through the outer channel.

The projections can advantageously include a plurality of pins. Each of the pins is affixed to the web of the inner channel. Preferably, one of the projections is aligned with an aligned pair of notches in the legs of the outer channel.

Although the locking member can be locked in the closed position in different ways, in a preferred construction, the locking means includes a tab on the locking member adjacent one end of the locking member. An aperture extends through the tab, and a locking element is coupled to one of the channels and is adapted to project through the aperture. The locking element has an opening therein for receiving a lock.

Preferably, both ends of the channel are closed. One end of the channel can advantageously be closed by a tab on the locking member. The tab also forms a means to facilitate grasping and sliding of the locking member.

The support member can be mounted with the grooves opening in various different directions, such as upwardly or laterally. Upwardly opening grooves are particularly desirable for suspending articles on the supporting member.

The invention, together with further features and advantages thereof, may best be understood by reference to the following description taken in connection with the accompanying illustrative drawings.

DESCRIPTION OF THE PREFERRED EMBODIMENTS

Figure 1:
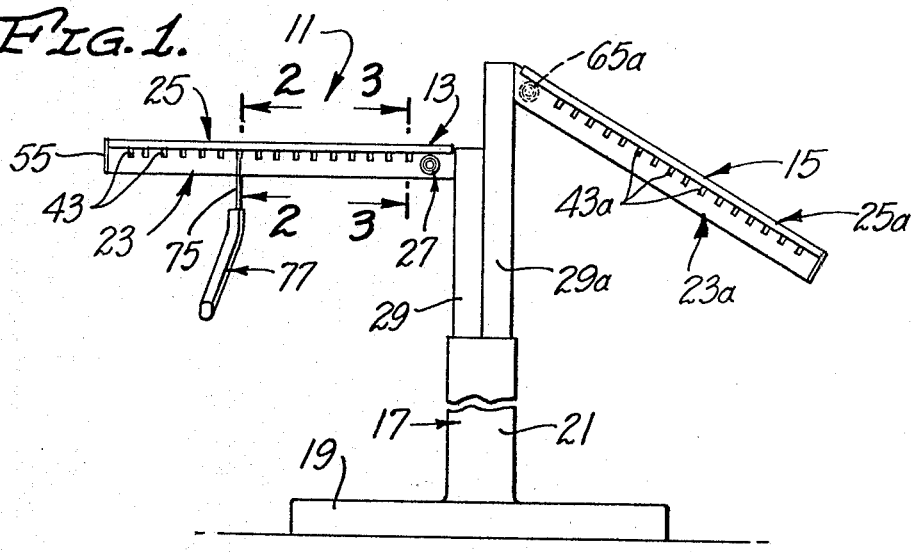
FIG. 1 is an elevational view of one form of a security display rack constructed in accordance with the teachings of this invention.

FIG. 1 shows a security display rack 11 which includes security display devices 13 and 15 and a base assembly 17. Although the base assembly can be of various different constructions, a commonly used base assembly includes a very heavy base 19 and a tubular riser 21 extending vertically upwardly from a central region of the base. The security display rack 11 is of the type which can be advantageously used for displaying articles, such as men's suits.

The security display device 13 includes an elongated support member 23, an elongated locking member 25 mounted on the support member, locking means 27 for locking the locking member on the support member, and a post 29 suitably rigidly affixed to one end of the support member and extending perpendicular thereto. The lower end of the post 29 is telescopically received within the riser 21. Conventional detent means (not shown) retain the post 29 in any one of a plurality of selected vertically spaced positions within the riser 21. The base assembly 17 is of the type commonly found in department stores, and the display device 13 is adapted for retrofit on these existing base assemblies.

Figure 2:
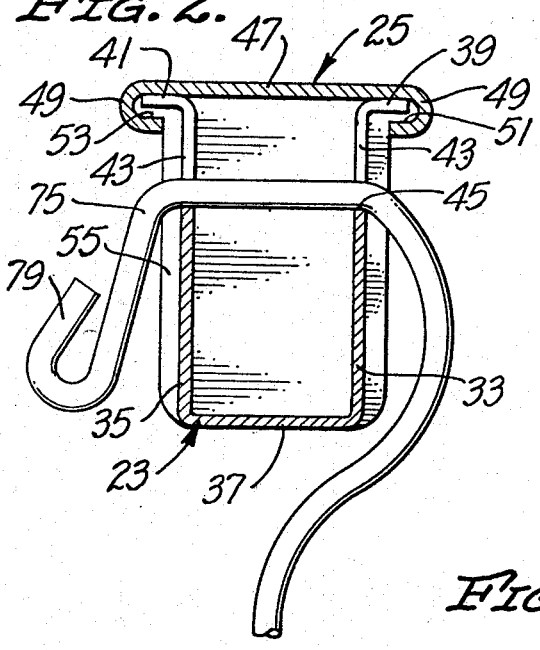
FIG. 2 is an enlarged sectional view taken generally along line 2—2 of FIG. 1.

The support member 23 can advantageously take the form of a steel channel (FIG. 2) which includes a pair of parallel legs 33 and 35 integrally joined together by a web 37 which is perpendicular to the legs. The end portions of the legs 33 and 35 remote from the web 37 are turned outwardly to form integral flanges 39 and 41, respectively, which extend discontinuously for the full length of the associated legs. A plurality of grooves are formed in the support member and, in the embodiment illustrated, each of the grooves includes a pair of aligned groove sections or notches 43 formed in the legs 33 and 35. Each of the notches 43 has an end surface 45 and opens at the free ends of the associated legs 33 and 35, which free ends form an elongated surface of the support member 23. The presence of the notches 43 causes the flanges 39 and 41 to be discontinuous. The end surface 45 is spaced upwardly as shown in FIG. 2 from the web 37. One end of the channel-shaped support member 23 is closed by the post 29.

The locking member 25 in the embodiment illustrated is an integral member preferably constructed of a strong material, such as steel. The locking member 25 has an elongated cover section 47 (FIG. 2) and integral reverse bend sections 49 extending along the opposite longitudinal edges of the cover section to define elongated recesses 51 and 53. One end of the locking member has an enlarged tab 55 extending downwardly from the locking member to close the adjacent end of the support member 23 in the closed position of the locking member.

The support member 23 and the locking member 25 are sized so that the recesses 51 and 53 can slidably receive the flanges 39 and 41, respectively, to mount the locking member 25 on the support member 23 for sliding movement along the end of the support member remote from the web 37. The locking member 25 can be slid along the support member 23 to open and close the open upper ends of the notches 43 as may be desired. The locking member 25 can be moved to a position in which it closes the upper ends of all of the notches 43 to define a closed position of the locking member. In the embodiment illustrated, the locking member 25 can be moved until the tab 55 abuts the end of the support member whereupon further movement of the locking member to the right is prevented.

Figure 3:
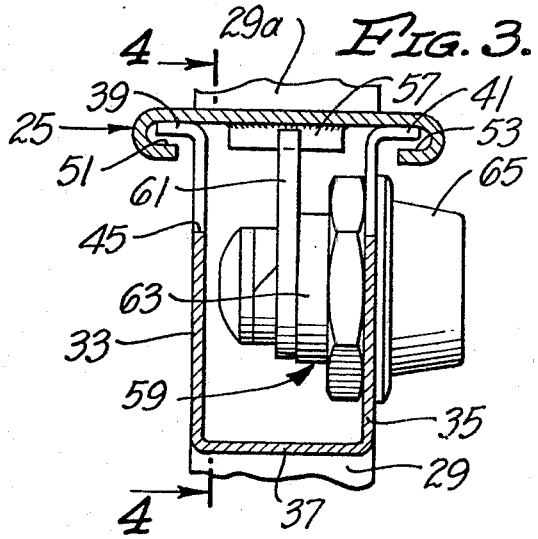
FIG. 3 is an enlarged sectional view taken generally along line 3—3 of FIG. 1.
Figure 4:
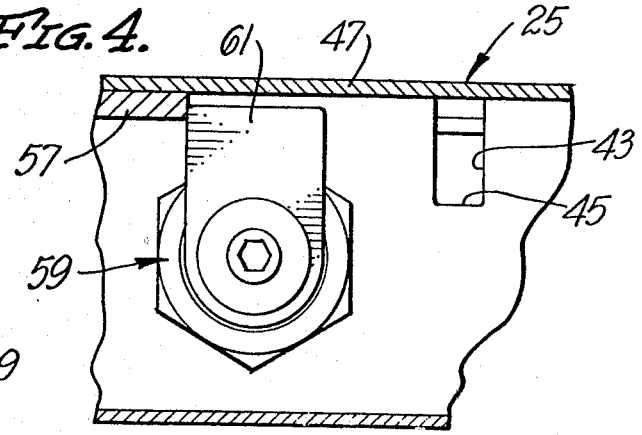
FIG. 4 is a fragmentary sectional view taken generally along line 4—4 of FIG. 3.
Figure 5:
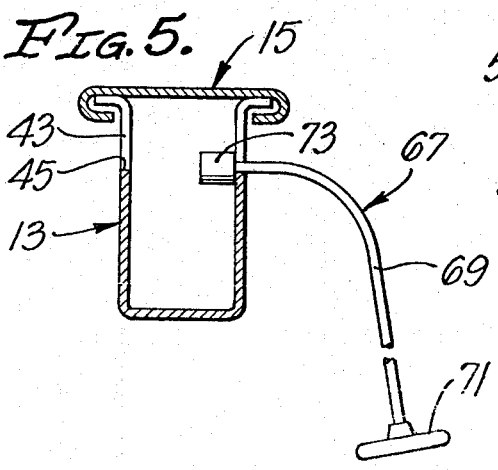
FIG. 5 is a sectional view similar to FIG. 2 showing how a leash can be used with the support member.

The locking means 27 can then be used to lock the locking member 25 in the closed position. Although the locking means 27 may take different forms, in the embodiment illustrated, it includes a locking element 57 (FIGS. 3 and 4) rigidly affixed to the locking member 25 and extending downwardly into the channel-shaped support member 23. The locking means also includes a key lock 59 of conventional construction and mounted on the support member 23. The lock 59 includes a locking element 61 within the channel-shaped support member, a rotatable member 63 carrying the locking element 61, and a key receiving unit 65. By inserting an appropriate key into the unit 65, the rotatable member 63 and the locking element 61 can be rotated between locking and releasing positions. In the locking position, the locking element 61 engages one end of the locking element 57 to prevent movement of the locking member 25 to the right as viewed in FIG. 4. The locking element 61 cannot be moved out of the locking position without the key. In the releasing position, the locking element 61 is rotated clockwise as viewed in FIG. 4 so that it will not interfere with passage of the locking element 57.

The security display device 13 may also include a conventional leash 67 for purposes to be described. The leash 67 includes an elongated flexible cable 69 and enlargements 71 and 73 affixed to opposite ends of the cable.

In use of the rack 11, with the locking member 25 in the open position, the wire loop portion 75 of a coat hanger 77 may be placed into an aligned pair of the notches 43 as shown in FIG. 2. The garment to be displayed, such as a man's suit, is hung on the coat hanger. The locking member 25 is then slid to the closed position, and the key (not shown) is used to move the locking element 61 to its locking position. In this position, the locking member 25 closes the upper ends of the notches 43 into which the wire loop portion 75 is placed so that the coat hanger cannot be removed from the support member 23 by lifting it upwardly. Moreover, the wire loop portion 75 has the usual enlargement 79 at the free end thereof, and this enlargement prevents withdrawal of the coat hanger by pulling or rotating it. Accordingly, the coat hanger cannot be removed from the support member without unlocking the locking means 27. Alternatively, the notches 43 can be larger so that the hanger 77 can only be withdrawn with difficulty.

If desired, each of the hangers 77 may have one of the leashes 67 associated therewith. In this event, the leash 67 is run through the sleeve of the jacket hung on the hanger and the enlargement 71 lies on the outside of the usual suit jacket buttonhole. The cable 69 is sufficiently long so that the coat can be put on by a customer but to free the coat from the display rack 11, the cable must be withdrawn from the support member 23 and pulled completely through the jacket sleeve and the jacket buttonhole. The enlargement 73 is small enough to pass through the buttonhole.

The security display device 15 is identical to the security display device 13, except that the support member **23*a* is inclined relative to the post 29*a* so that the support member extends downwardly as it extends away from the post. By way of example, the angle of inclination may be 30 degrees relative to the horizontal. A key receiving unit 65*a* is adapted to receive the key from the opposite side of the display rack 11. Of course, the dimensions of the components of the devices 13 and 15 can be different and portions of the device 15 corresponding to portions of the device 13** are indicated by corresponding reference numerals followed by the letter "a."

Figure 6:
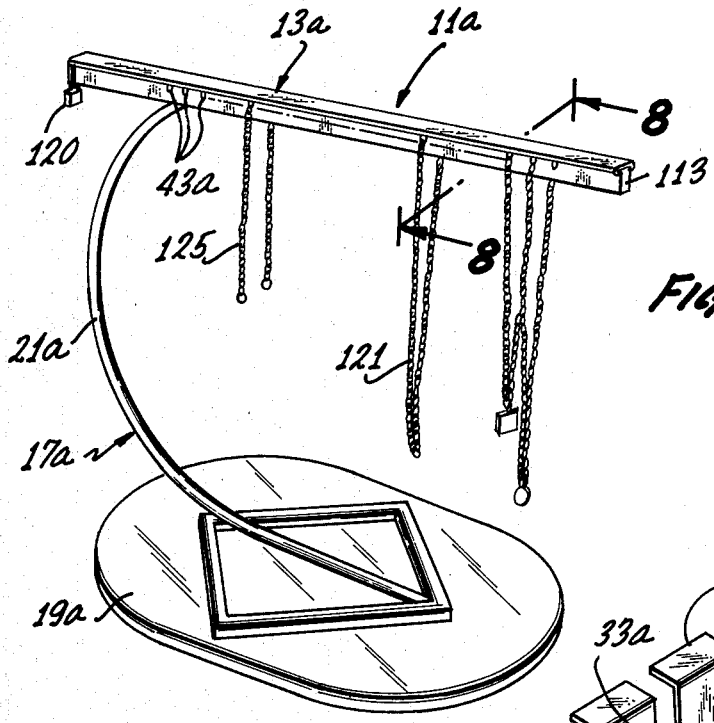
FIG. 6 is an isometric view of a second form of security display rack constructed in accordance with the teachings of this invention.
Figure 7:
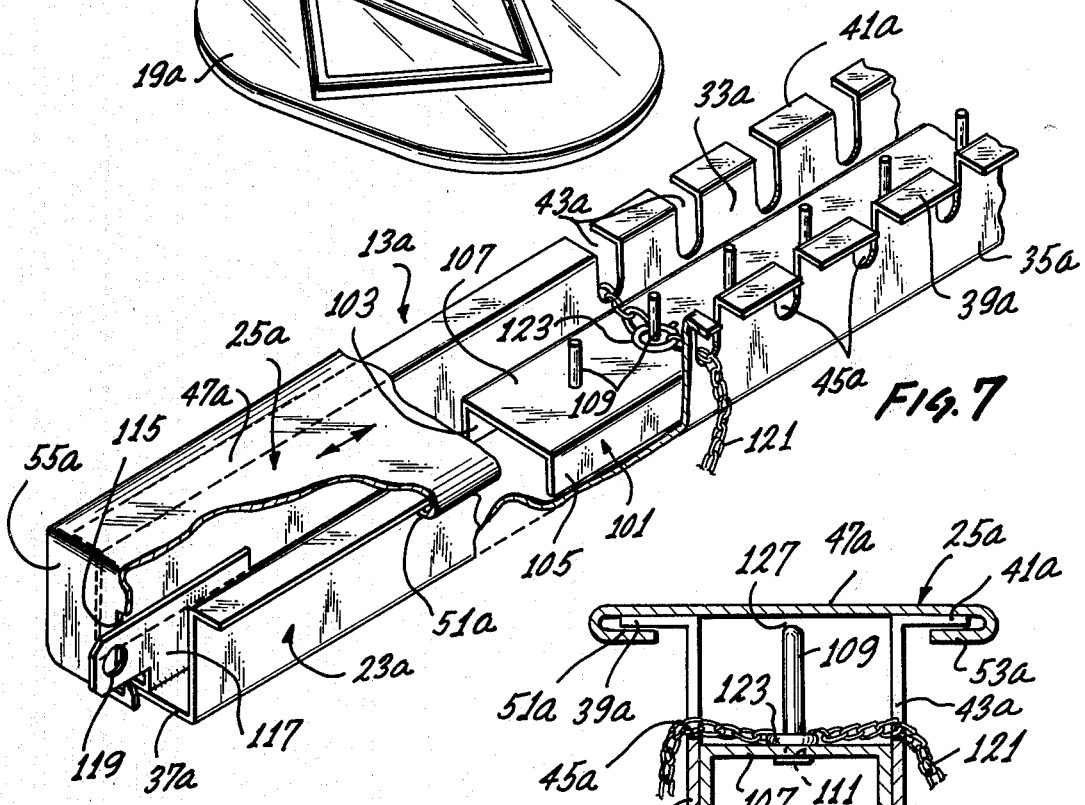
FIG. 7 is a fragmentary isometric view with portions broken away of the security display rack of FIG. 6.
Figure 8:
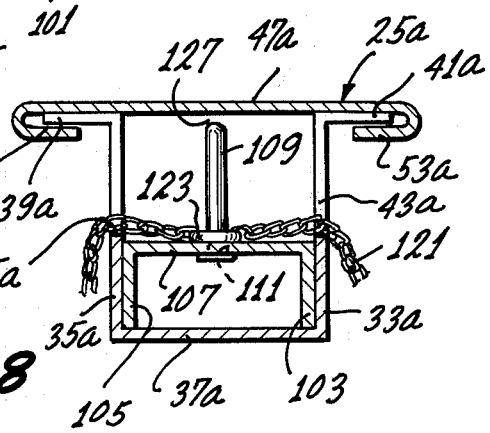
FIG. 8 is a sectional view taken generally along line 8—8 of FIG. 6.

FIGS. 6–8 show a security display rack **11*a* which is identical to the security display rack 11 in all respects not shown or described herein. Portions of the security display rack 11*a* corresponding to portions of the security display rack 11** are designated by corresponding reference numerals followed by the letter "a."

Both the security display device **13*a* and the base assembly 17*a* differ from the corresponding portions of the security display rack 11. Although the base assembly 17*a* can be of various different constructions, in the embodiment shown in FIGS. 6–8, the base assembly 17*a* includes a base 19*a* which is adapted for placement on a counter and a tubular, arcuate riser 21*a* extending generally upwardly from a central region of the base 19*a*. The riser 21*a* is coupled to the base 19*a* and to the underside of the display device 13*a***.

With reference to FIGS. 7 and 8, the primary difference between the display device **13*a* and the display device 13 is that the former includes an inner channel 101 which includes first and second parallel legs 103 and 105 interconnected by a web 107 which is perpendicular to the legs 103 and 105. The inner channel 101 is received in the support member or outer channel 23*a* with the legs 103 and 105 of the inner channel 101 extending from the web 107 toward the web 37*a*. The legs 103 and 105 are shorter, as viewed in cross section, than the legs 33*a* and 35*a*, and the legs 103 and 105 preferably engage the web 37*a* as shown in FIG. 8. The inner channel 101 is sized to be received within the outer channel 23*a*. The inner channel 101, which may be constructed of a strong material, such as steel, can be affixed to the outer channel 23*a* in various different ways, including welding. The inner channel 101 lies between the end surface or bottoms 45*a* of the notches 43*a* and the web 37*a***.

A plurality of projections in the form of pins 109 is affixed to the web 107, with the pins extending away from the webs 107 and **37*a* toward the open upper end of the outer channel 23*a*. Each of the pins 109 is preferably constructed of a strong material, such as steel. Each of the pins 109 is attached to the web 107 in any suitable manner, such as by inserting it through an opening 111 in the web 107 and staking it or otherwise affixing it in position. One of the pins is provided in alignment with opposed pairs of notches 43*a* as shown in FIGS. 7 and 8. The pins extend upwardly and terminate beneath the cover section 47*a* as shown in FIG. 8**.

One end of the outer channel **23*a* is closed by an end plate 113 (FIG. 6) which is welded or otherwise secured to the outer channel. The other end of the outer channel 23*a* is closed by the tab 55*a* when the locking member 25*a*** is in the closed position.

In order to lock the locking member **25*a* in the closed position, the tab 55*a* has an aperture 115 which is sized to receive an end portion of a locking element 117 which is welded or otherwise rigidly secured to the web 37*a* adjacent one end of the outer channel 23*a*. The locking element 117 in the embodiment illustrated, is in the form of a thin plate and has an opening 119 in its outer end through which the loop of a padlock or other suitable lock 120 can be inserted to thereby lock the locking member 25*a*** in the closed position.

To install an article for display, such as a necklace 121, the locking member 25*a* is slid to the left as viewed in FIG. 7 to the open position. The necklace 121, which may already be affixed in a loop configuration, is slid over the end of the display device 13*a* and placed within an opposed pair of the notches 43*a*. Alternatively, the necklace 121 may be placed through an opposed pair of the notches 43*a* and then the clasp can be locked to affix the necklace into a loop configuration. The necklace 121 includes at least one ring 123, which may be part of the necklace or part of the clasp. One of the rings 123 is placed over the pin 109 which is in alignment with the aligned notches 43*a* through which the necklace projects. Thereafter, the locking member 25*a* is slid to the right to the closed position and locked in the closed position using a padlock (not shown).

If the pins 109 were not provided, the display rack 11*a* would be much less effective in preventing theft of the necklace 121 in that the thief could pull the necklace 121 through the notches 43*a* to expose the clasp, and by undoing the clasp, the necklace could be pulled from the display rack. The pin 109, however, prevents the necklace from being pulled through the notches 43*a*. In addition, even if the clasp is open and exposed as shown by the necklace 125 in FIG. 6, the pin 109 prevents pulling of the necklace out of the outer channel 23*a*. In this regard, the pin 109 extends upwardly to such an extent that a gap 127 between the pin 109 and the locking member 25*a* is too small to permit removal of the ring 123. Thus, unauthorized removal of the unclasped necklace 125 is prevented.

Although exemplary embodiments of the invention have been shown and described, many changes, modifications and substitutions may be made by one having ordinary skill in the art without necessarily departing from the spirit and scope of this invention.

I claim:

1. A security display rack for articles, said rack comprising:

an elongated outer channel having first and second legs and a web interconnecting said legs, said legs extending from the web and at least said first leg terminating in an elongated outer edge;

at least said first leg having a plurality of notches extending through said first leg and opening at said outer edge of the first leg;

an inner channel having first and second legs and a web interconnecting said legs of said inner channel;

said inner channel being received in said outer channel with said legs of said inner channel extending from the web of the inner channel toward the web of the outer channel;

a plurality of projections carried by the web of the inner channel and extending away from said webs of said channels, each of said projections being adapted to engage one of the articles with such article projecting through at least one of said notches;

an elongated locking member;

means for mounting the elongated locking member on the outer channel for movement between a closed position in which the locking member closes the open ends of the notches sufficiently to impede removal of the articles from the notches and an open position in which the articles can be removed from the notches and the projections;

locking means for locking the locking member in said closed position; and means coupled to the outer channel for elevating the outer channel above a surface.

2. A security display rack as defined in claim 1 wherein said second leg of the outer channel terminates in an elongated outer edge, said second leg of the outer channel having a plurality of notches extending through said second leg and opening at said outer edge of the second leg whereby one of the articles can extend through one notch on the first leg and a corresponding notch on the second leg.

3. A security display rack as defined in claim 1 wherein the legs of the inner channel extend from the web of the inner channel a distance less than the distance which the legs of the outer channel extend from the web of the outer channel and the legs of the inner channel space the webs of the inner and outer channels.

4. A security display rack as defined in claim 1 wherein at least one of the projections includes a pin extending through the web of the inner channel, said pin being carried by the web of the inner channel.

5. A security display rack as defined in claim 1 wherein said mounting means includes at least one flange on one of said outer channel and said locking member and at least one recess on the other of said outer channel and said locking member, said one flange being received in said one recess to permit the locking member to be slid over the open ends of the notches to open and at least partially close the open ends of the notches.

6. A security display rack as defined in claim 1 wherein said locking means includes a tab on the locking member adjacent one end of the locking member, an aperture extending through said tab, and a locking element coupled to at least one of said channels and adapted to project through said aperture, said locking element having an opening therein for receiving a lock.

7. A security display rack as defined in claim 1 wherein each of said notches extends from said outer edge to a bottom and said inner channel lies between the bottoms of said notches and said web of said outer channel.

8. A security display rack as defined in claim 1 wherein said second leg of the outer channel terminates in an elongated outer edge, said second leg of said outer channel having a plurality of notches extending through the second leg and opening at said outer edge of the second leg whereby one of the articles can extend through corresponding notches of the first and second legs and engage an associated one of the projections, each of said projections including a pin carried by the web of the inner channel and each of said notches extends from the outer edge of the associated leg to a bottom and said inner channel lies between the bottoms of said notches and said web of said outer channel.

9. A security display rack for articles, said rack comprising:

an elongated support member having an elongated surface and a plurality of grooves extending through the support member and opening at said elongated surface;

a plurality of elongated pins coupled to said support member, each of said pins being adapted to engage one of the articles with such article projecting through at least one of the grooves to the exterior of the elongated support member;

an elongated locking member;

at least one flange on one of said members and at least one recess on the other of said members, said one flange being received in said one recess to permit the locking member to be slid over the open ends of the grooves between a closed position in which the locking member at least partially closes the open ends of the grooves sufficiently to impede removal of the articles from the grooves and an open position in which the locking member leaves the grooves sufficiently open so that the articles can be removed therefrom;

locking means for locking the locking member in said closed position; and means coupled to the support member for elevating the member above a support surface.

* * * * *